US006904640B2

(12) United States Patent
Jin et al.

(10) Patent No.: US 6,904,640 B2
(45) Date of Patent: Jun. 14, 2005

(54) JOINT ASSEMBLY OF VACUUM CLEANER AND VACUUM CLEANER HAVING THE SAME

(75) Inventors: Hyoung-jong Jin, Gwangju (KR); Jang-keun Oh, Gwangju (KR)

(73) Assignee: Samsung Gwangju Electronics Co., Gwangju (KR)

( * ) Notice: Subject to any disclaimer, the term of this patent is extended or adjusted under 35 U.S.C. 154(b) by 320 days.

(21) Appl. No.: 10/207,036

(22) Filed: Jul. 30, 2002

(65) Prior Publication Data

US 2003/0167595 A1 Sep. 11, 2003

(30) Foreign Application Priority Data

Mar. 5, 2002 (KR) ..... 2002-11510

(51) Int. Cl.[7] ..... A47L 9/24; A47L 9/32

(52) U.S. Cl. ..... 15/410; 15/377

(58) Field of Search ..... 15/377, 410, 414; 285/7, 145.2, 145.3, 146.1

(56) References Cited

U.S. PATENT DOCUMENTS

| | | | | | |
|---|---|---|---|---|---|
| 4,307,484 | A | * | 12/1981 | Williams | 15/321 |
| 4,423,559 | A | * | 1/1984 | Malin | 37/335 |
| 5,083,340 | A | * | 1/1992 | Takahashi et al. | 15/410 |
| 5,113,547 | A | * | 5/1992 | Mayhew | 15/322 |
| 5,542,147 | A | * | 8/1996 | Merten | 15/321 |
| 6,125,502 | A | * | 10/2000 | Hammeken et al. | 15/411 |
| 6,581,974 | B1 | * | 6/2003 | Ragner et al. | 285/7 |
| 6,695,352 | B2 | | 2/2004 | Park et al. | |

FOREIGN PATENT DOCUMENTS

| | | |
|---|---|---|
| CN | 1369250 A | 9/2002 |
| DE | 39 03 451 A1 | 8/1990 |
| EP | 08 75 195 A1 | 11/1998 |
| EP | 0 875 195 | 11/1998 |
| EP | 0 882 422 | 12/1998 |
| EP | 1 031 312 | 8/2000 |
| EP | 1 226 777 | 7/2002 |
| FR | 2 772 585 | 6/1999 |
| GB | 2 368 266 | 5/2002 |
| JP | 06 07 872 a | 3/1994 |
| SE | 518 135 | 9/2002 |
| WO | WO 89/07412 | 8/1989 |

OTHER PUBLICATIONS

Canadian Patent Office, Canadian Official Action issued Jul. 6, 2004 with respect to Canadian Patent Application No. 2,399,848 filed on Aug. 27, 2002.

Official Action issued Apr. 6, 2004 by the Russian Patent Office with respect to Russian Patent Application No. 2002121917 filed Aug. 9, 2002.

German Examination Report issued Mar. 5, 2004 from the German Patent Office with respect to German Patent Application No. 10240632.4 filed Sep. 3, 2002.

British Patent Office Search Report (3pp.).

Chinese Office Action dated Dec. 31, 2004 for Chinese Application No.: 02130134.4, filed Aug. 23, 2002.

* cited by examiner

*Primary Examiner*—Terrence R. Till
(74) *Attorney, Agent, or Firm*—Blank Rome LLP

(57) ABSTRACT

A vacuum cleaner having a joint assembly to selectively rotate an extension pipe with respect to a handle. The joint assembly has a joint body removably installed between the extension pipe and the handle to allow the extension pipe 130 to rotate with respect to the handle 140 within a predetermined range. Also included on the joint assembly is a supplemental handle protruding from an outer surface of the joint body. The joint assembly and supplemental handle allow the user to clean under a bed or a desk without having to bend his/her back too much. Therefore, the user is not easily fatigued even when he/she cleans under the desk or bed.

13 Claims, 7 Drawing Sheets

JOINT ASSEMBLY OF VACUUM CLEANER AND VACUUM CLEANER HAVING THE SAME

FIELD OF INVENTION

The present invention relates to a vacuum cleaner, and more particularly, to a joint assembly disposed between an extension pipe and a handle in order to help a user feel less fatigued when using a vacuum cleaner.

BACKGROUND OF THE INVENTION

As shown in FIGS. 1 and 2, a conventional vacuum cleaner 100 includes a vacuum cleaner body 110 having a suction motor 111, a dust-collecting chamber 113, a suction assembly 120 to draw in dust and air on a cleaning surface, an extension pipe 130 installed between the suction assembly 120 and the vacuum cleaner body 110 in order to form an air passage, a handle 140, and an extension hose 150.

The air drawn through the suction assembly 120 flows to the dust-collecting chamber 113 of the vacuum cleaner body 110 after passing through the extension pipe 130, the handle 140, and the extension hose 150 as shown by the arrow in FIG. 2. Filth contained in the air drawn into the dust-collecting chamber 113 is filtered by a dust-collecting filter 115. The air cleaned by the dust-collecting filter 115 is discharged to the outside through an exhausting port 117 formed at a predetermined position of the vacuum cleaner body 110 after passing through the suction motor 111.

The user grips the handle 140 with one hand in order to clean the surface, and moves the suction assembly 120 thereon to draw in dust. However, when the conventional vacuum cleaner 100 is used to clean under a bed or a desk, the user has to bend his/her back so that the extension pipe 130 is parallel to the cleaning surface. When the user performs this cleaning operation for a long period of time, the user may feel tired and hurt his/her back. In addition, when the vacuum cleaner 100 is used while gripping the handle 140 with only one hand, the load of the suction assembly 120 is concentrated in that hand, thus, increasing the user's fatigue.

To solve the above problems, some users grip the extension pipe 130 with the hand that is not gripping the handle 140. However, this requires the user to bend his/her back to grip the extension pipe 130, causing fatigue after using the vacuum cleaner 100 for long periods of time.

FIG. 2 shows a vacuum cleaner 100 having a cyclone dust-collecting apparatus 160 installed between the extension pipe 130 and the handle 140 in order to improve the cleaning efficiency of the vacuum cleaner 100.

The cyclone dust-collecting apparatus 160 is used to separate filth from the drawn air passing through the extension pipe 130. The filth is separated from the drawn air in the cyclone dust-collecting apparatus 160 by centrifugal force, and falls by its own weight to be collected at the bottom of the cyclone dust-collecting apparatus 160. Accordingly, the cyclone dust-collecting apparatus 160 should be maintained at a predetermined angle with respect to the floor in order to effectively maintain the filth separation efficiency.

However, when the conventional vacuum cleaner 100 is used to clean under a desk or a bed, as shown in FIG. 2 with a solid line, the extension pipe 130 and the cyclone dust-collecting apparatus 160 are angled downward. Accordingly, cyclone air current generated in the cyclone dust-collecting apparatus 160 is destroyed, and the separated dust is collected at a side of the cyclone dust-collecting apparatus 160, lowering the dust separation efficiency.

SUMMARY AND OBJECTS OF THE INVENTION

The present invention has been made to overcome the above-mentioned problems of the prior art. Accordingly, it is an object of the present invention to provide a vacuum cleaner and a joint assembly disposed between an extension pipe and a handle in order prevent user fatigue when cleaning under a bed or desk.

Moreover, according to another preferred embodiment of the present invention, it is a second object of the present invention to provide a joint assembly having a supplemental handle to allow the user to grip the supplemental handle in order to lessen fatigue.

In addition, according to another aspect of the present invention, it is a third object of the present invention to provide a joint assembly disposed between an extension pipe and a cyclone dust-collecting apparatus, installed at a lower part of the handle, so that the filth separation efficiency is not lessened even though the user lowers the extension pipe to a generally horizontal position.

A vacuum cleaner according to the present invention to accomplish the above objects includes a vacuum cleaner body, a suction port assembly to draw in filth on a cleaning surface, a handle connected to the vacuum cleaner body, an extension pipe connecting the handle with the suction port assembly, and a joint assembly removably installed between the extension pipe and the handle to allow the extension pipe and the handle to rotate with respect to each other within a predetermined range.

Additionally, the angle between the extension pipe and the handle is adjustable, preventing user fatigue when the user bends his/her back to clean under a bed or a desk.

According to the preferred embodiment of the present invention, the joint assembly includes a joint body removably installed between an extension pipe and a handle, and disposed to form an air passage from the suction port assembly to the vacuum cleaner body. The joint body connects the extension pipe to the handle and allows the extension pipe to rotate with respect to the handle within a predetermined range. In addition, a supplemental handle is provided that protrudes from an outer surface of the joint body allowing the user to use both hands to move the suction port assembly, thereby reducing user fatigue.

The joint body includes a first joint pipe having a first pivot portion at one end, while the other end is removably connected with the extension pipe, and a second joint pipe having a second pivot portion formed at one end to be rotatably connected with the first pivot portion, while the other end is removably connected with the handle. Moreover, it is preferable that a housing cover the connection area of the first pivot portion and the second pivot portion, and that the supplemental handle protrude from an outer surface of the housing.

The invention also includes a locking device to lock the rotational position of the first and second joint pipes in order to maintain their position, when the first joint pipe is rotated with respect to the second joint pipe to a predetermined angle.

The locking device comprises locking recessions respectively formed at the first pivot portion and the second pivot portion. The locking recessions overlap each other when the first joint pipe and the second joint pipe are rotated to a predetermined angle and a locking lever is rotatably disposed at one side of the housing with a locking protrusion locking the locking recessions after passing through the housing. A spring member disposed inside of the housing flexibly presses one side of the locking lever to direct the locking protrusion into the locking recession. In particular, the locking device locks the rotational movement of the extension pipe and the handle when the two are linearly aligned.

The vacuum cleaner according to the another aspect of the present invention comprises a cyclone dust-collecting apparatus removably installed between the joint assembly and the handle in order to discharge clean air to the handle after using centrifugal force to separate dust from the dust-laden air passing through the joint assembly.

Here, the joint assembly includes a curved side dented towards the inside of the joint assembly and corresponding to an outer contour of the cyclone dust-collecting apparatus. The curved side covers some outer part of the cyclone dust-collecting apparatus when the cyclone dust-collecting apparatus is installed.

BRIEF DESCRIPTION OF THE DRAWINGS

The above-mentioned object and the feature of the present invention will be more apparent by describing the preferred embodiment of the present invention by referring to the appended drawings, in which.

DETAILED DESCRIPTION OF THE INVENTION

Figure 1:
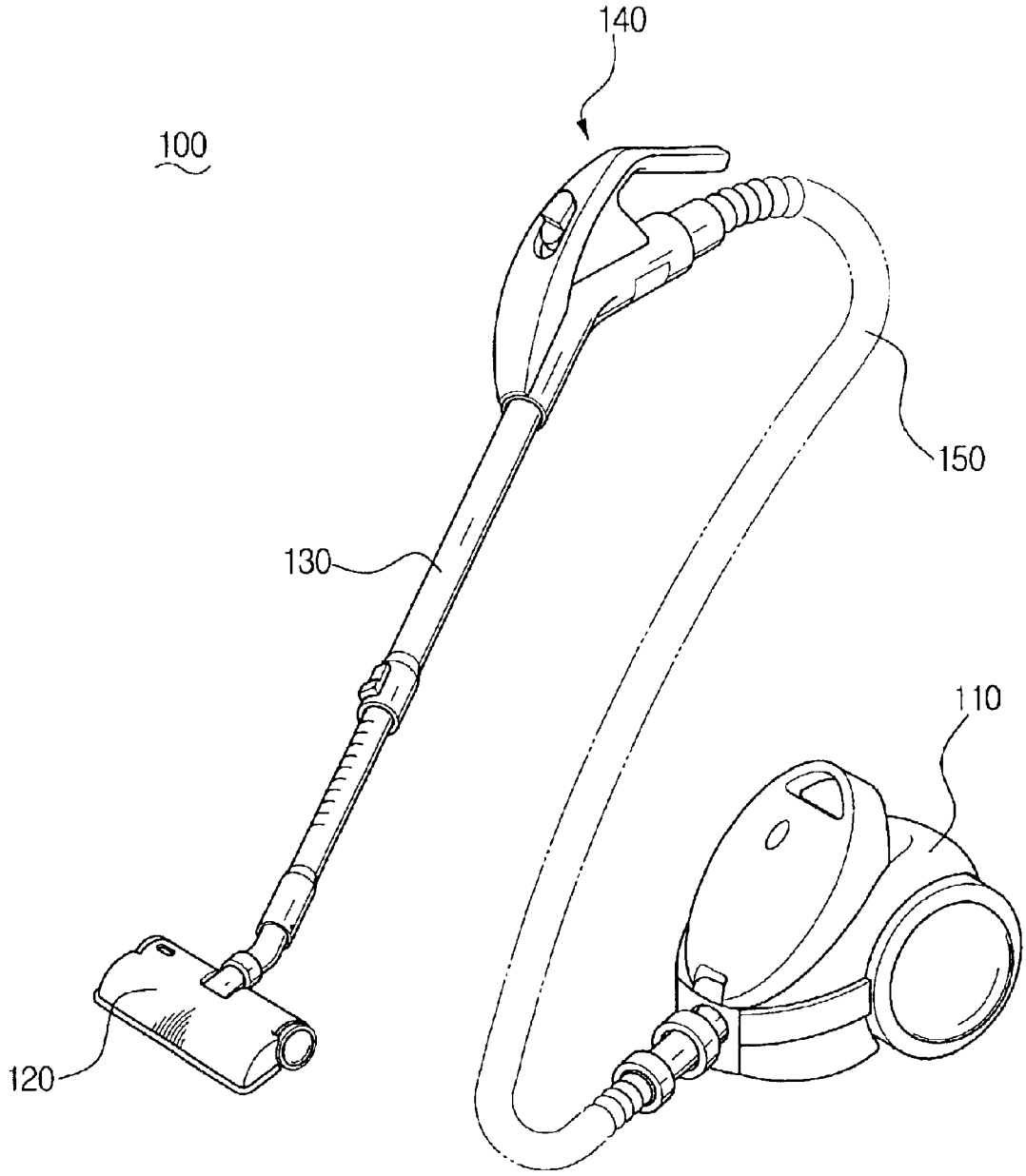
FIG. 1 (PRIOR ART)
FIG. 1 is a perspective view drawing showing a conventional vacuum cleaner.

Hereinbelow, the preferred embodiments of the present invention will be described in greater detail by referring to the appended drawings. For the description of the preferred embodiments of the present invention, elements having the same function and structure with the elements of the conventional vacuum cleaner described and shown in FIGS. 1 and 2, will be given the same reference numerals and the description of the same elements will be omitted.

Figure 3:
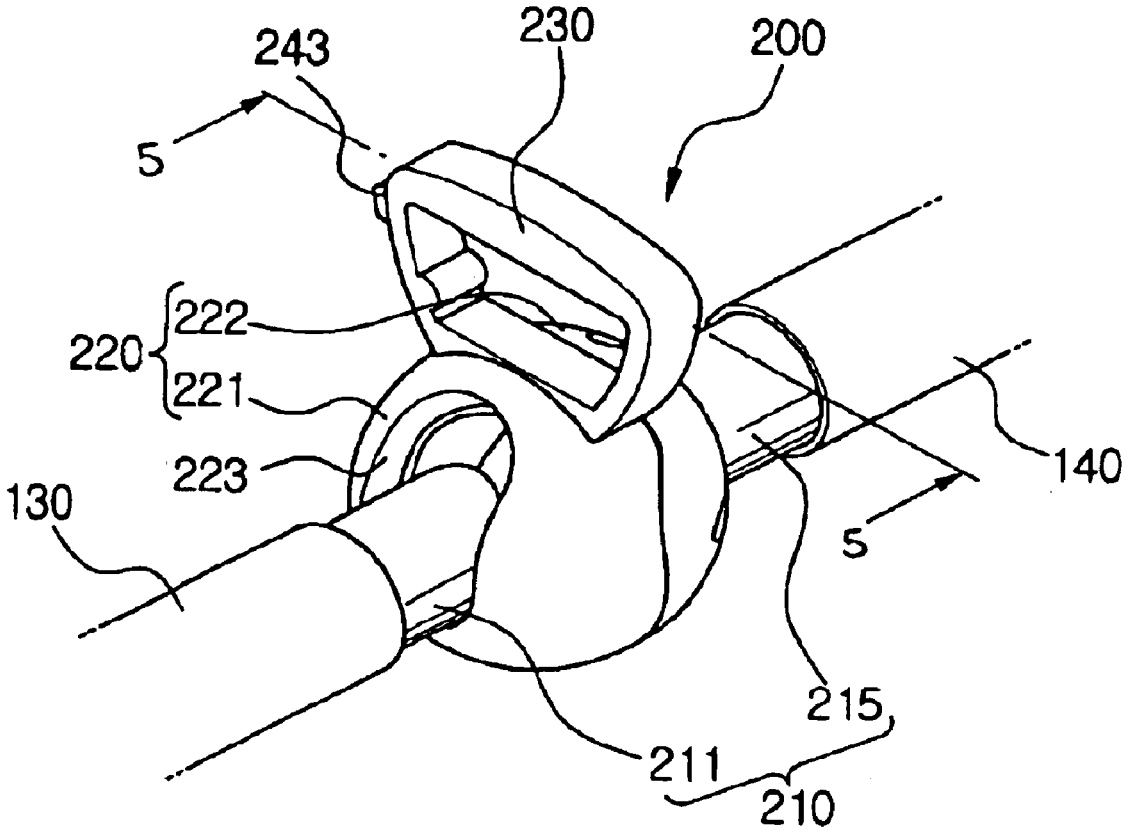
FIG. 3 is a perspective view drawing showing a joint assembly installed on a vacuum cleaner according to the preferred embodiment of the present invention.

Referring to FIG. 3, a vacuum cleaner 100 according to the present invention has a joint assembly 200 removably installed between an extension pipe 130 and a handle 140. The joint assembly 200 includes a joint body 210 whose ends are respectively connected with the extension pipe 130 and the handle 140, and a supplementary handle 230 protruding from an outer surface of the joint assembly 200. The extension pipe 130 is connected to be rotated within a predetermined range with respect to the handle 140 by the joint assembly 200.

Figure 4:
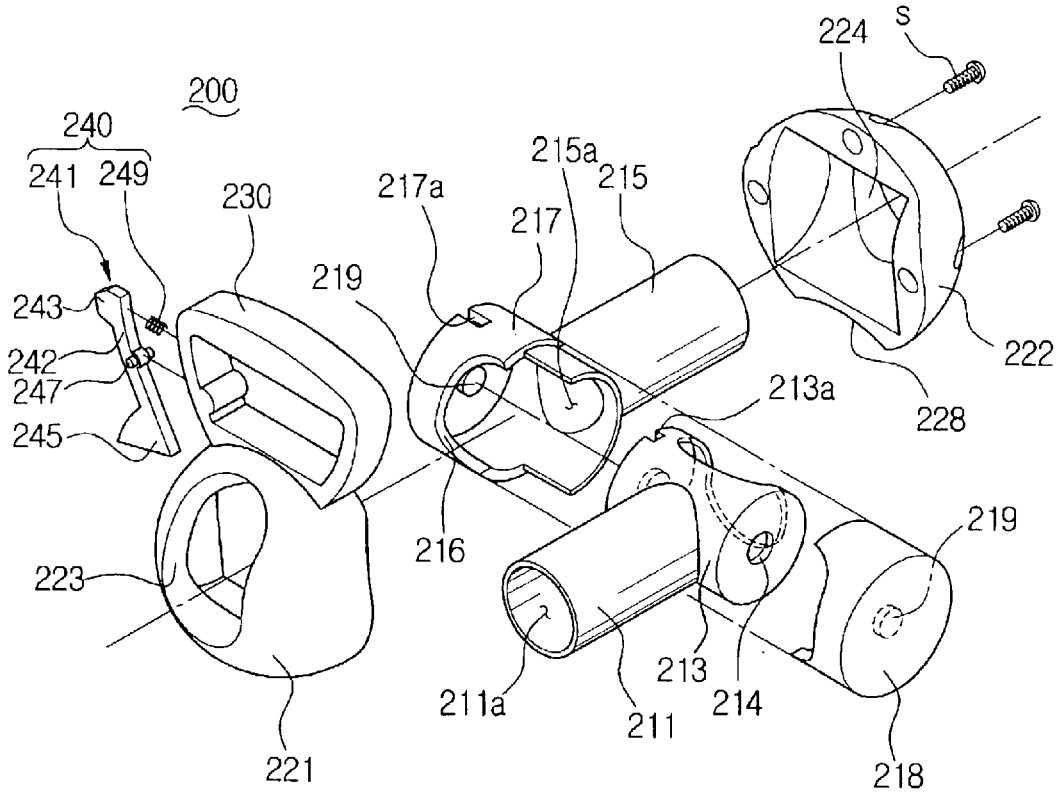
FIG. 4 is an exploded perspective view drawing showing the joint assembly of FIG. 3.

As shown in FIG. 4, the joint body 210 includes a first joint pipe 211 and a second joint pipe 215 connected for rotation. One end of the first joint pipe 211 is removably connected with an end portion of the extension pipe 130 and a first pivot portion 213 is formed at the other end of the first joint pipe 211. The first pivot portion 213 has closed ends having a pair of pivot holes 214 formed therein. A barrel of the first pivot portion 213 has circular shaped openings facing each other for the passage of air. One of the openings is connected with an end portion of the first joint pipe 211, and the other end is in communication with a second air passage 215*a* of second joint pipe 215 when assembled. Thus, a first air passage 211*a* having open ends is formed inside of the first joint pipe 211 and the first pivot portion 213. The first air passage 211*a* is arranged on the same line with the extension pipe 130 when the first joint pipe 211 and the extension pipe 130 are connected with each other.

One end of the second joint pipe 215 is removably connected with the handle 140, and a second pivot portion 217 is formed at the other end of the second joint pipe 215. The second pivot portion 217 is connected with the first pivot portion 213 for rotation when the first joint pipe 211 and the second joint pipe 215 are connected with each other. The second pivot portion 217 is cylindrically shaped, having a closed end with a pin 219 therein. The other end of the second pivot portion 217 forms a rotation guide hole 216, which is open to accommodate the first pivot portion 213 when the first joint pipe 211 and the second joint pipe 215 are connected with each other. The second air passage 215*a*, which is identical with the first air passage 211*a*, is formed inside of the second joint pipe 215 and the second pivot portion 217.

The first pivot portion 213 and the second pivot portion 217 having the above structure are connected with each other for rotation as the first pivot portion 213 is inserted into the second pivot portion 217, and the pins 219 are inserted into the pivot holes 214. When assembled, the inner circumference of the second pivot portion 217 covers the outer circumference of the first pivot portion 213.

The rotation guide hole 216 is formed as an oval shape in the wall of the second pivot portion 217. Accordingly, when the first joint pipe 211 is rotated more than a predetermined angle with respect to the second joint pipe 215, the outer circumference of the first joint pipe 211 contacts the edge of the rotation guide hole 216, thereby preventing further rotational movement. In other words, the rotational range of the first joint pipe 211 with respect to the second joint pipe 215 is determined by the shape of the rotation guide hole 216.

In the meantime, the second pivot portion 217 includes a settlement cover 218 having a separated end to be easily connected with the first pivot portion 213. The settlement cover 218 includes a pin 219 that is inserted into the pivot hole 214 for securing the first pivot portion 213 between the settlement cover 218 and the second pivot portion 217. Accordingly, the first and the second joint pipes 211 and 215 are completely connected with each other as the settlement cover 218 is installed after the first pivot portion 213 is inserted into the second pivot portion 217.

The connection area of the first and the second joint pipes 211 and 215 are covered by a housing 220 (refer to FIG. 3). The housing 220 includes a first housing 221 and a second housing 222 connected to each other by a connection means S, such as a screw. The first housing 221 includes a first settlement hole 223 formed in the same shape as the rotation guide hole 216. Therefore, the first housing 221 covers the first joint pipe 211 around the connection area when the first joint pipe 211 is inserted through the first settlement hole 223. The first housing 221 also includes a supplemental handle 230 which protrudes from an outer surface of the first housing 221.

The second housing 222 includes a second settlement hole 224 formed at the center to have the same inner diameter as the outer diameter of the second joint pipe 215. Thus, the second housing 222 covers the second joint pipe 215 around the connection area when the second joint pipe 215 is inserted through the second settlement hole 224. When the first housing 221 installed at the first joint pipe 211, and the second housing 222 installed at the second joint pipe 215, are connected with each other, the joint assembly 200 becomes the shape of FIG. 3.

Figure 2:
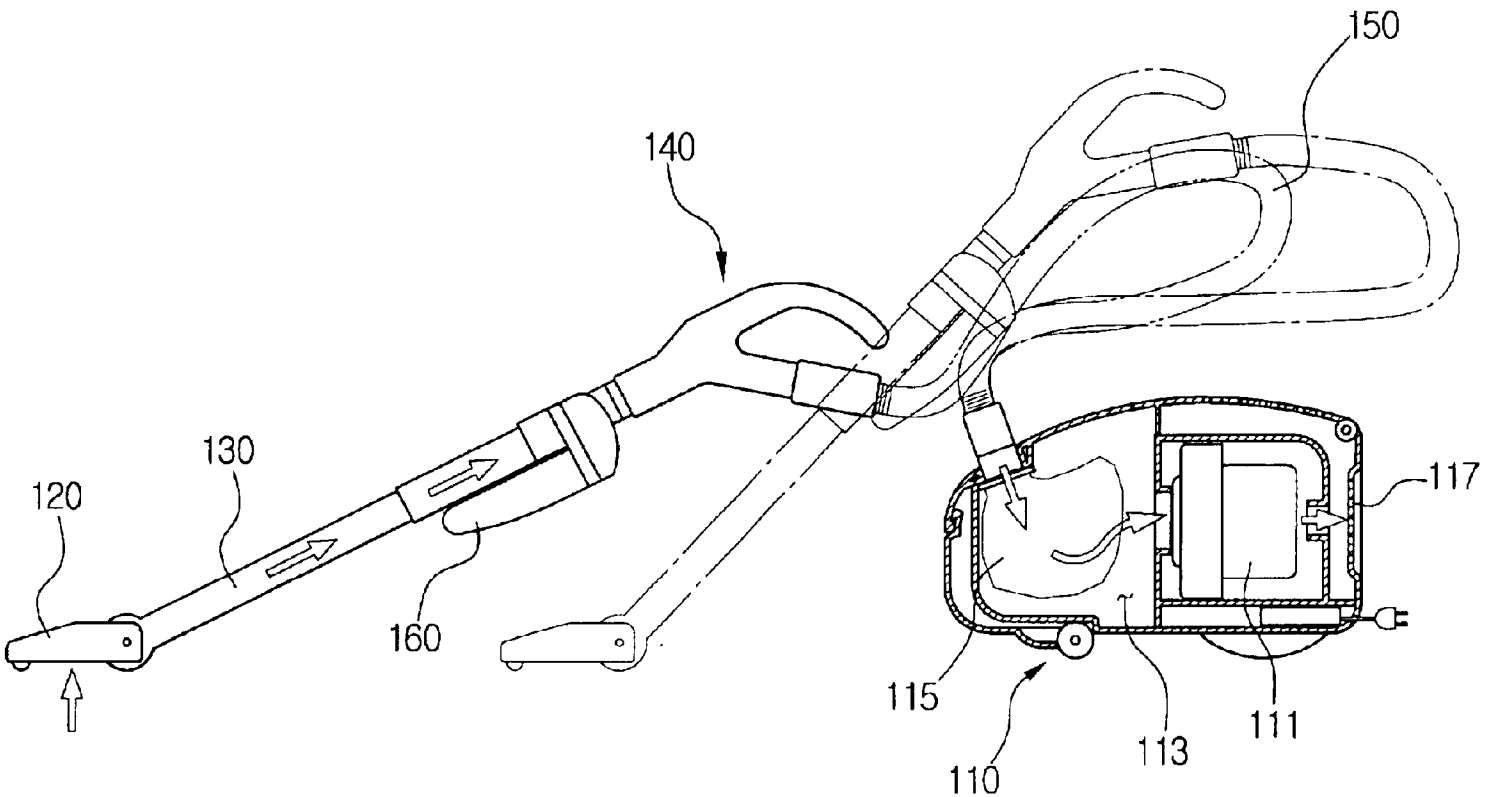
FIG.2 (PRIOR ART)
FIG. 2 is a side view drawing showing another conventional vacuum cleaner.

The supplemental handle 230 is disposed to allow the user to easily grip the supplemental handle 230 with the hand that is not gripping the handle 140 (refer to FIG. 1). The supplemental handle 230 is installed to reduce user fatigue when bending his/her back to use the vacuum cleaner 100. Without the supplemental handle 230, the user must grip the extension pipe 130 after gripping the handle 140 or grip only the handle 140. Therefore, with the supplemental handle 230, the user does not have to bend his/her back when using the vacuum cleaner 100 because the user can grip the supplemental handle 230 rather than the extension pipe 130. Accordingly, user fatigue is reduced when compared to using the conventional vacuum cleaner 100. It should be noted that the supplementary handle 230 of the preferred embodiment protrudes from an upper outer surface of the first housing 221 at a predetermined height and may have a variety of shapes to accommodate different users.

The joint assembly 200 further includes a locking device 240 to hold the first joint pipe 211 in position while the first joint pipe 211 is rotated with respect to the second joint pipe 215 within a predetermined range. The locking device 240 prevents the extension pipe 130 from rotating with respect to the handle 140 when using the vacuum cleaner. To secure the above function, the locking device 240 includes a locking lever 241 rotatably disposed at a slot-shaped settlement portion 232 along the outer wall of the housing 221, two locking recessions 213*a* and 217*a* formed at an outer side of the first and the second pivot portion 213 and 215, and a spring member 249 flexibly pressing the locking lever 241 in a direction so that the rotation of the first joint pipe 211 is locked.

Figure 5:
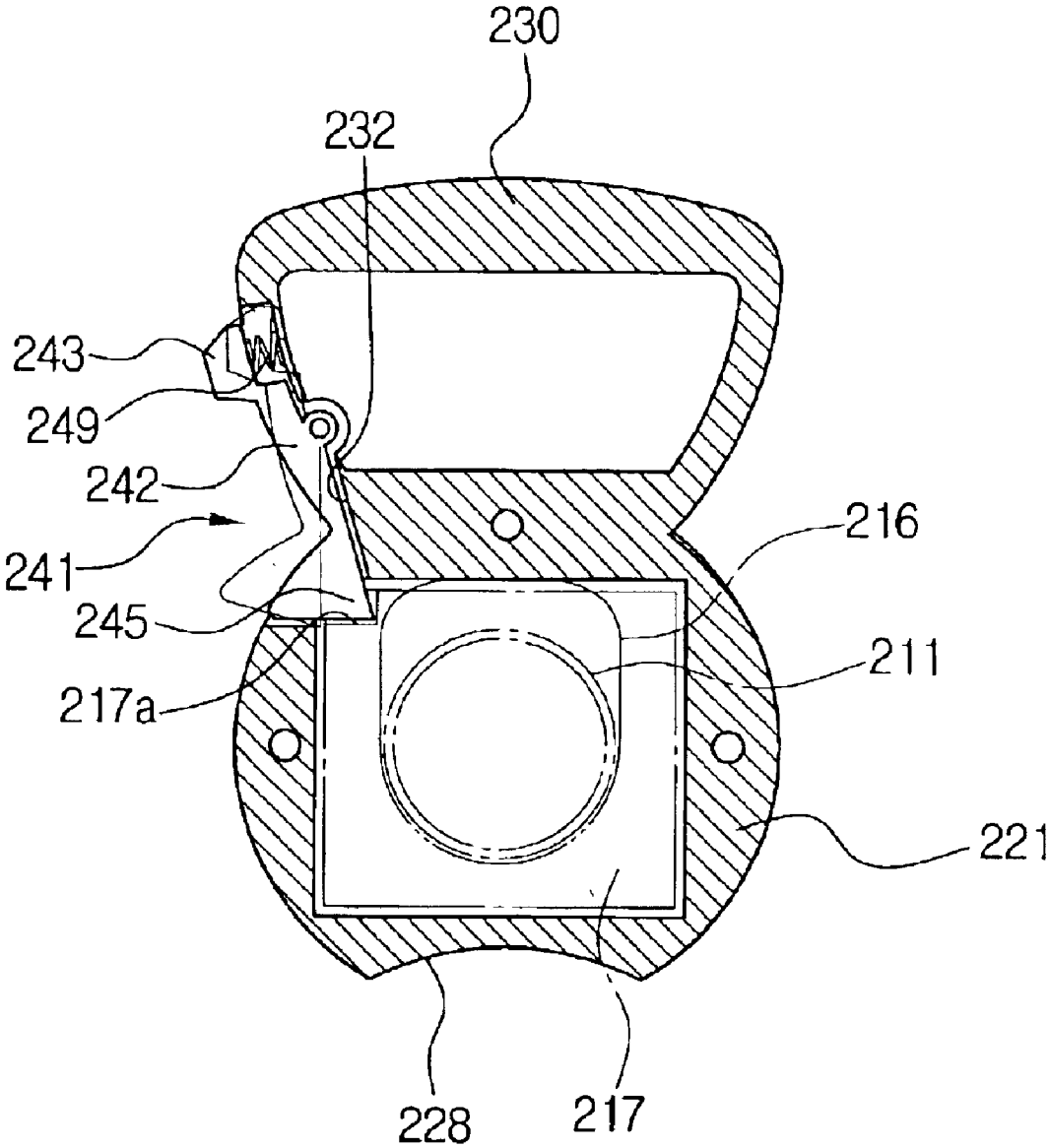
FIG. 5 is a partial view drawing showing a part of the joint assembly taken along the A—A line of FIG. 3.

As shown in FIG. 5, the locking lever 241 includes a lever body 242 protruding from a side of the supplementary handle 230, a manipulation portion 243 formed at an upper part of the lever body 242, and a locking protrusion 245 protruding at a lower part of the lever body 242. The locking protrusion 245 is inserted into the first locking recession 213*a* and the second locking recession 217*a* after passing through the inside of the settlement portion 232 when the first and the second locking recessions 213*a* and 217*a* are overlapped, so that the first joint pipe 211 and the second joint pipe 215 form a predetermined angle. When the locking protrusion 245 is inserted into the first locking recession 213*a* and the second locking recession 217*a*, the rotation of the first joint pipe 211 and the second joint pipe 215 are locked. To separate the locking protrusion 245 from the locking recessions 213*a* and 217*a*, the user presses the manipulation portion 243 formed at the upper part of the lever body 242 and rotates the lever body 242.

The lever body 242 of the preferred embodiment is installed at the settlement portion 232 to allow the manipulation portion 243 to protrude from a side of the supplemental handle 230. Pressing the manipulation portion 243 rotates the lever body 242, in particular the locking protrusion 245, out of engagement with the first and second locking recessions 213*a* and 217*a*, thereby releasing first and second joint pipes 211 and 215 from their locked positions.

The spring member 249 is installed at an upper part of the settlement portion 232 and biases the manipulation portion 243 to cause the locking protrusion 245 to be inserted into the locking recessions 213*a* and 217*a*. Accordingly, the locking protrusion 245 is biased to the inside of the settlement portion 232, and is inserted into the locking recessions 213*a* and 217*a* when the first and the second locking recessions 213*a* and 217*a* are overlapped.

The rotation angle of the first and second joint pipes 211 and 215 for locking the locking recessions 213*a* and 217*a* is established when the joint assembly 200 is manufactured. In the preferred embodiment of the present invention, the locked position of the first and the second joint pipes 211 and 215 is when the first and second joint pipes 211 and 215 are arranged in a linear fashion, i.e., when the extension pipe 130 and the end portion of the handle 140 are on the same line.

Figure 6:
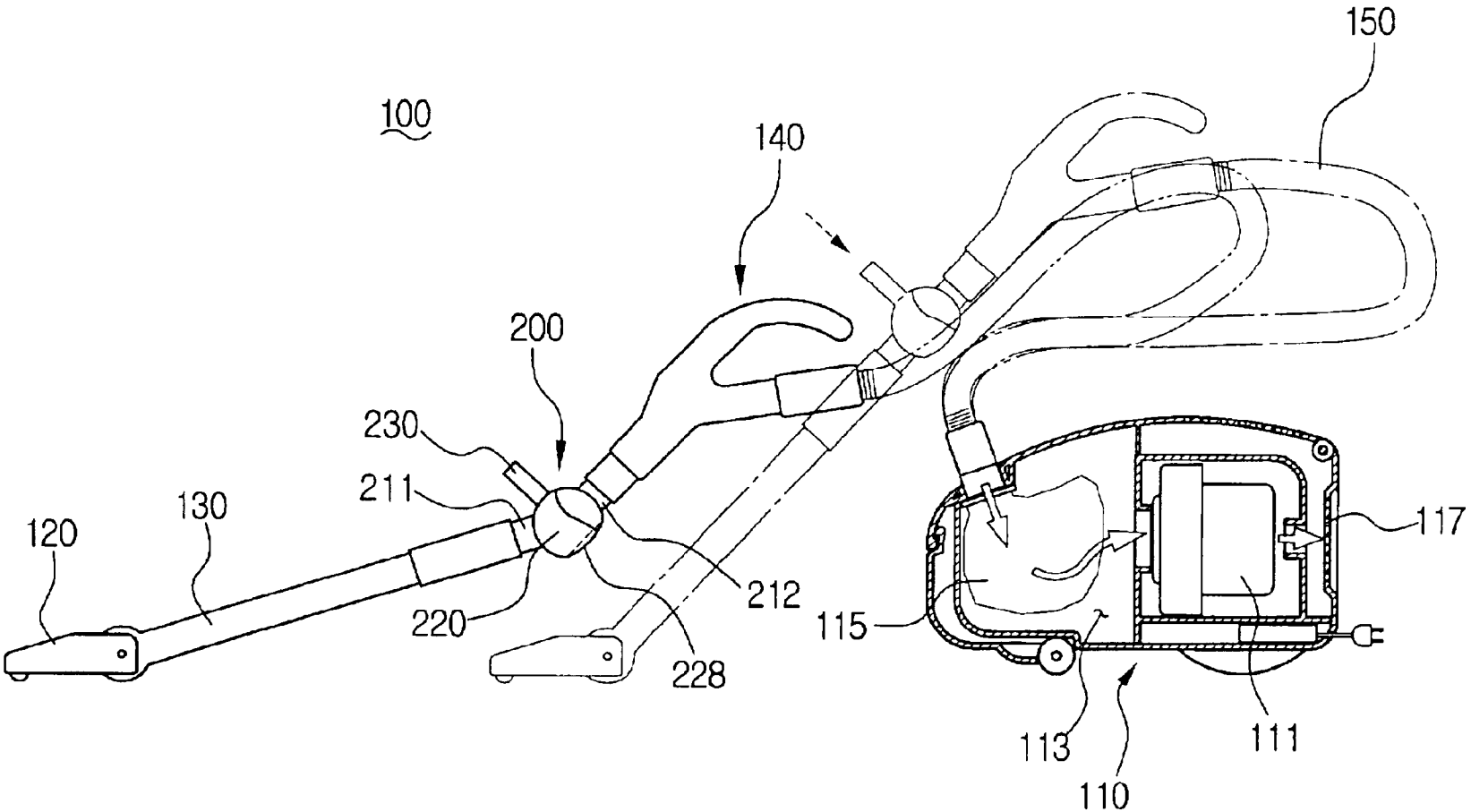
FIG. 6 is a side view drawing showing the vacuum cleaner according to the preferred embodiment of the present invention.

When the joint assembly 200 having the above structure is installed between the extension pipe 130 and the handle 140, the rotation angle can be changed freely as shown in FIG. 6. Thus, the user does not have to bend his/her back too much when cleaning under a desk or bed. To rotate the extension pipe 130 with respect to the handle 140, the user presses the manipulation portion 243 protruding from the side of the supplementary handle 230 and releases the lock of the joint assembly 200. Then, the user pushes the handle 140 downwardly in the direction of the dotted arrow, and rotates the first joint pipe 211 and the second joint pipe 215 about the rotation axis of the first and the second pivot portion 213 and 217. Moreover, when no change of the rotation angle is required, the user can use the vacuum cleaner 100 where the extension pipe 130 and the handle 140 are linearly aligned.

Figure 7:
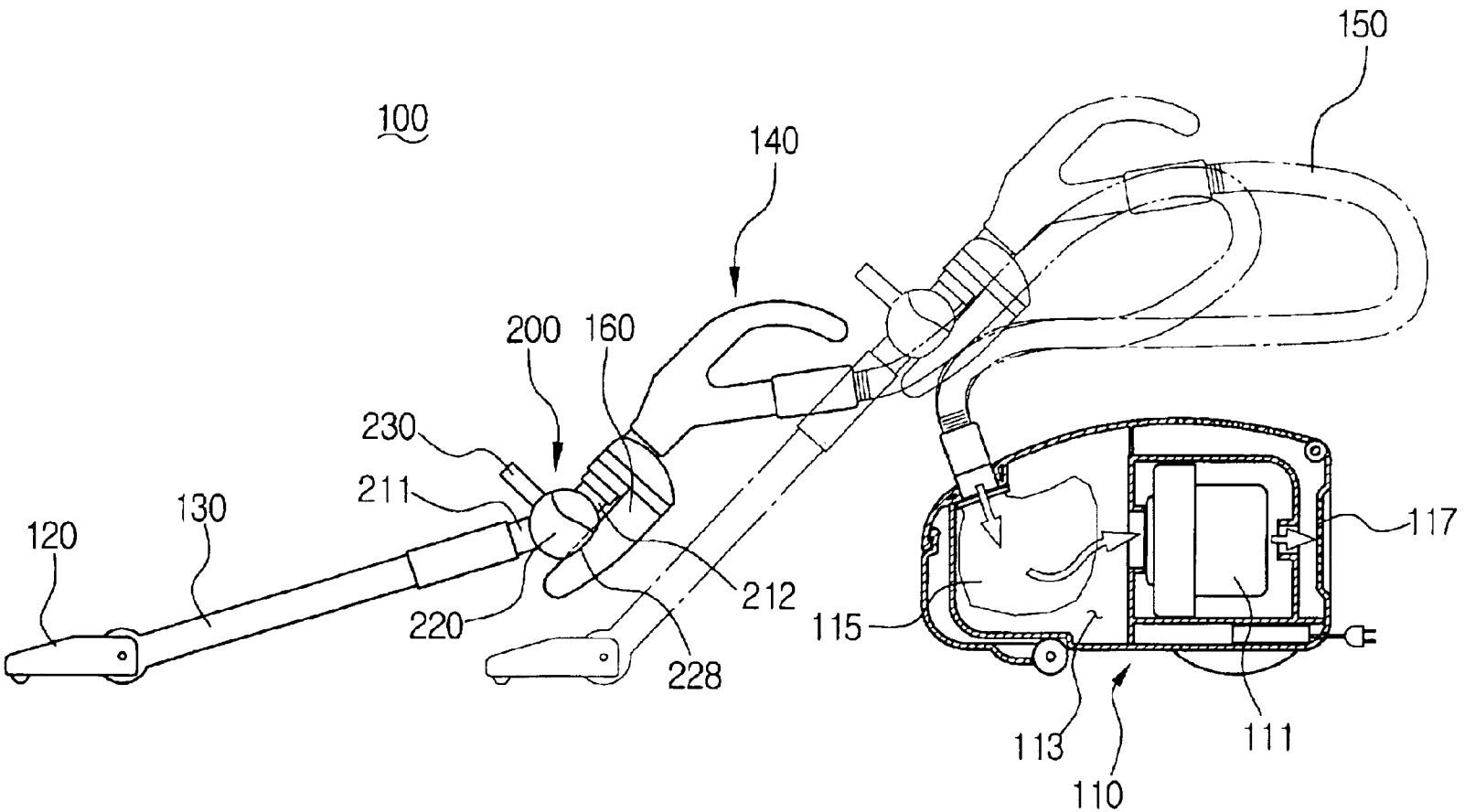
FIG. 7 is a side view drawing showing the vacuum cleaner according to another preferred embodiment of the present invention.

FIG. 7 shows another preferred embodiment of the present invention. In the second preferred embodiment, the vacuum cleaner 100 has a cyclone dust-collecting apparatus 160 disposed between the joint assembly 200 and the handle 140.

The cyclone dust-collecting apparatus 160 separates dust from dust-laden air passing through the suction port assembly 120, the extension pipe 130, and the joint assembly 200 by using centrifugal force to separate the filth included in the air. The cleaned air is then discharged to the handle 140 and the separated filth falls by its own weight and is collected at the bottom of the cyclone dust-collecting apparatus 160. The cleaning efficiency of the cyclone dust-collecting apparatus 160 is dependent upon its angle with respect to the floor, with its efficiency increasing as the cyclone dust-collecting apparatus 160 becomes more perpendicular to the floor.

A further advantage of a vacuum cleaner 100 using the joint assembly 200 is that the angle of the cyclone dust-collecting apparatus 160 can be constantly maintained even when the extension pipe 130 is almost horizontal with the floor. Therefore, the cleaning efficiency of the cyclone dust-collecting apparatus 160 is not lowered when a user cleans under a desk or a bed.

When the cyclone dust-collecting apparatus 160 is installed between the joint assembly 200 and the handle 140, a curved side 228 is formed on the side of the housing 220 adjacent the cyclone dust-collecting apparatus 160 in order to minimize the installation space of the cyclone dust-collecting apparatus 160. The curved side 228 is formed to be dented to the inside of the housing 220 so that the housing 220 covers some part of the cyclone dust-collecting apparatus 160.

However, it should be understood that the joint assembly 200 is not limited to the above described preferred embodiments. As long as the joint assembly 200 is removably installed between the handle 140 and the extension pipe 130 for rotation, and the rotation can be selectively locked and released, the joint assembly 200 can be modified and still be within the scope of the invention.

Accordingly, the present invention having the above structure allows the user to freely change the angle of the extension pipe 130 and the handle 140, reducing the need to bend his/her back when cleaning under a desk or bed. In this way, the user is not easily fatigued.

In addition, the supplemental handle 130 allows the user to use both his/her hands to grip the vacuum cleaner. Thus, the user feels less fatigued when compared to a user who does not have a supplemental handle and must grip the vacuum cleaner with one hand.

Moreover, as there is a locking device 240 to lock the rotation of the joint body 210 at a predetermined angle, the extension pipe 130 is rotated with respect to the handle 140 only when desired, and the joint assembly 200 is prevented from being rotated by external forces.

Although the preferred embodiments of the present invention have been described, it will be understood by those skilled in the art that the present invention should not be limited to the described preferred embodiments, but various changes and modifications can be made within the spirit and the scope of the present invention.

What is claimed is:

1. A joint assembly of a vacuum cleaner comprising:

a joint body removably installed between an extension pipe and a handle, being disposed to form an air passage for air drawn from a suction port assembly to flow to a vacuum cleaner body, the joint body connecting the extension pipe with the handle to allow the extension pipe to rotate with respect to the handle within a predetermined range; and a supplemental handle protruding from an outer surface of the joint body.

2. The joint assembly of a vacuum cleaner of claim 1, wherein:

the joint body includes a first joint pipe having a first pivot portion at one end while the other end is removably connected with the extension pipe, and a second joint pipe having a second pivot portion formed at one end to be rotatably connected with the first pivot portion while the other end is removably connected with the handle.

3. The joint assembly of a vacuum cleaner of claim 2, further comprising:

a housing to cover a connection area of the first pivot portion and the second pivot portion; and wherein the supplemental handle protrudes from an outer surface of the housing.

4. The joint assembly of a vacuum cleaner of claim 3, further comprising:

a locking device to lock the rotational movement of the first joint pipe with respect to the second joint pipe in order to maintain the position of the joint pipes at a predetermined angle.

5. The joint assembly of a vacuum cleaner of claim 4, wherein:

the first pivot portion and the second pivot portion include locking recessions that overlap each other when the first joint pipe and the second joint pipe are rotated to the predetermined angle;

a locking lever rotatably disposed at one side of the housing and having a locking protrusion that engages the locking recessions after passing through the housing; and a spring member disposed inside of the housing in order to bias the locking lever in a direction so that the locking protrusion is inserted into the locking recessions.

6. The joint assembly of a vacuum cleaner of claim 4, wherein:

the locking device locks the rotational movement of the extension pipe and the handle when they are linearly aligned.

7. A vacuum cleaner comprising:

a vacuum cleaner body;

a suction port assembly to draw in filth from a cleaning surface;

a handle connected with the vacuum cleaner body;

at least one extension pipe to connect the handle with the suction port assembly; and a joint assembly removably installed on the at least one extension pipe to allow the handle and the at least one extension pipe to rotate with respect to each other within a predetermined range, the joint assembly including a supplemental handle protruding from an outer surface of the joint assembly.

8. The vacuum cleaner of claim 7, wherein:

the joint assembly includes a joint body removably installed between the at least one extension pipe and the handle; and the supplemental handle protrudes from an outer surface of the joint body.

9. The vacuum cleaner of claim 8, wherein:

the joint body includes a first joint pipe having a first pivot portion at one end while the other end is removably connected with the extension pipe, and a second joint pipe having a second pivot portion formed at one end to be rotatably connected with the first pivot portion while the other end is removably connected with the handle.

10. The vacuum cleaner of claim 9, further comprising:

a housing to cover the connection area of the first pivot portion and the second pivot portion; and wherein the supplemental handle protrudes from an outer surface of the housing.

11. The vacuum cleaner of claim 10, further comprising:

a locking device to lock the rotational movement of the first joint pipe and the second joint pipe at a predetermined angle.

12. The vacuum cleaner of claim 7, further comprising:

a cyclone dust-collecting apparatus removably installed between the joint assembly and the handle, the cyclone dust-collecting apparatus using centrifugal force to separate dust from dust-laden air in order to discharge clean air to the handle.

13. The vacuum cleaner of claim 12, wherein:

the joint assembly further includes a curved side dented towards an interior of the joint assembly and corresponding to an outer contour of the cyclone dust-collecting apparatus at an area contacting the cyclone dust-collecting apparatus, and wherein the curved side covers some outer part of the cyclone dust-collecting apparatus when the cyclone dust-collecting apparatus is installed.

* * * * *